US005319342A

United States Patent [19]

Kuroki

[11] Patent Number: 5,319,342

[45] Date of Patent: Jun. 7, 1994

[54] FLAT TRANSFORMER

[75] Inventor: Kazuhiko Kuroki, Osaka, Japan

[73] Assignee: Kami Electronics Ind. Co., Ltd., Japan

[21] Appl. No.: 79,867

[22] Filed: Jun. 23, 1993

[30] Foreign Application Priority Data

Dec. 29, 1992 [JP] Japan ..... 4-360792

[51] Int. Cl.[5] ..... H01F 27/30

[52] U.S. Cl. ..... 336/170; 336/182; 336/200; 336/232

[58] Field of Search ..... 336/180, 182, 200, 232, 336/185, 170, 83

[56] References Cited

U.S. PATENT DOCUMENTS 3,483,499 12/1969 Lugten ..... 336/200
4,012,703 3/1977 Chamberlayne ..... 336/83
4,547,961 10/1985 Bokil et al. ..... 336/200

FOREIGN PATENT DOCUMENTS 58-106813 6/1983 Japan .

*Primary Examiner*—Thomas J. Kozma
*Attorney, Agent, or Firm*—Bacon & Thomas

[57] ABSTRACT

A magnetic core (2) is formed so as to be vertically thin and segmentable into an upper segment (3) and a lower segment (4). An inner portion (2*a*) and two outer portions (2*b*), (2*b*) of the magnetic core (2) are interconnected so as to form a closed magnetic circuit. A substrate (9) is inserted between the two outer portions (2*b*), (2*b*), while the inner portion (2*a*) is inserted into a through hole (10) of the substrate (9). A scroll pattern coil (11) is formed on each of front surface (9*a*) and rear surface (9*b*) of the substrate (9) outside the through hole (10). Further, a bobbinless winding coil (13) is inserted into an annular space between the inner portion (2*a*) and the through hole (10).

7 Claims, 4 Drawing Sheets

FLAT TRANSFORMER

BACKGROUND OF THE INVENTION

1. Field of the Invention

The present invention relates to small, flat transformers to be mounted on a printed circuit board or the like. More specifically, the invention relates to a transformer suitable for use in the liquid-crystal back-light power supply system.

2. Description of the Prior Art

The inventor has known a transformer, as shown in FIG. 5, for use in the back-light power supply system. FIG. 5 (A) is a plan view of the transformer; FIG. 5 (B) is a sectional view taken along the line B—B of FIG. 5 (A) in the arrow direction; and FIG. 5 (C) is an electrical circuit diagram of the transformer.

A magnetic core 52 of a conventional transformer 51 is equipped with a left segment 53 and a right segment 54 both formed in section into a laid-down T shape. A bobbin 55 is fitted to the magnetic core 52 at its inner portion 52*a*. A first winding coil 61 and a second winding coil 62 are wound around one of a plurality of sections of the bobbin 55. Further, third winding coil 63 are wound around the remaining sections of the bobbin 55. In mounting the above-described transformer 51 onto a back-light power supply PCB (printed circuit board), which is not shown, a plurality of lead terminals 65 are previously bent at right angles, the bending ends of the terminals are each inserted into a connecting hole of the PCB, and thereafter the bending ends are soldered.

The aforementioned prior-art transformer has the following problems.

With a recent tendency of downsizing electronic equipment, the diameter of liquid-crystal oriented back-light lamps is being increasingly changed from conventional 4.5 mm (approx. 0.18 inch) to 2.5 mm (approx. 0.1 inch). Along with such a change, there has arisen a strong demand for setting the thickness of the above transformers to be used in the back-light power supply system to 2.5 mm, equal to the foregoing, or less than that.

However, thickness G of the conventional transformer 51 is the sum of thickness D of the inner portion 52*a* of the magnetic core 52, two times winding thickness E of each winding coil 61 or 62 or 63, and two times wall thickness F of the bobbin 55. It is of great difficulty to make these sizes D, E, and F smaller than as they are, which has accounted for the fact that it has been impossible to reduce the thickness G of the transformer 51 to less than 4.5 mm.

SUMMARY OF THE INVENTION

Accordingly, the object of the present invention is to reduce the thickness of a transformer.

In order to achieve the object, according to the present invention, a transformer is constructed as described below.

A magnetic core is formed so as to be vertically thin and also vertically segmentable. An inner portion and two outer portions of the magnetic core are interconnected in such a way as to form a closed magnetic circuit. A substrate is inserted between the two outer portions, while the inner portion is inserted into a through hole provided between front surface and rear surface of the substrate. Outside the through hole and on at least one of the front and rear surfaces is formed a pattern coil which is a scroll conductor pattern. Further, a winding coil formed into a thin, ring shape is inserted into an annular space between the inner portion and the through hole.

With the above construction, since the inner portion of the magnetic core, the winding coil, and the substrate are arranged radially in order, the inner portion and the winding coil will not overlap each other in the vertical direction. Thus, the transformer of the present invention allows its thickness to be reduced by two times the value of the winding thickness of the conventional winding coil, compared with the conventional transformer described before.

BRIEF DESCRIPTION OF THE DRAWINGS

FIG. 1 (A) is a plan view of the transformer;

FIG. 1 (B) is a sectional view taken along the line B—B of FIG. 1 (A) in the arrow direction;

FIG. 2 is a sectional view taken along the line II—II of FIG. 1 (A) in the arrow direction;

FIG. 3 is a circuit diagram of the transformer;

FIG. 4 is a schematic view showing the assembly process of a substrate to be used in the transformer;

FIG. 5 (B) is a sectional view taken along the line B—B of FIG. 5 (A) in the arrow direction; and FIG. 5 (C) is a circuit diagram of the conventional transformer.

DESCRIPTION OF THE PREFERRED EMBODIMENT

A preferred embodiment of the present invention is described below with reference to the accompanying drawings.

Figure 1B:
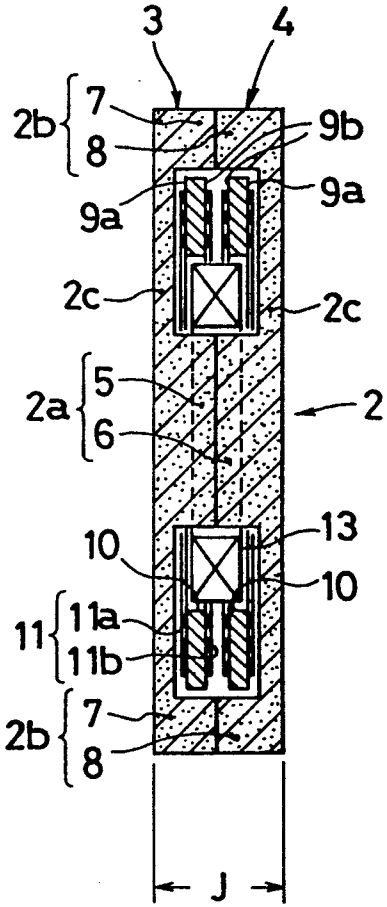
FIGS. 1 to 4 illustrating an embodiment of the present invention.
Figure 1A:
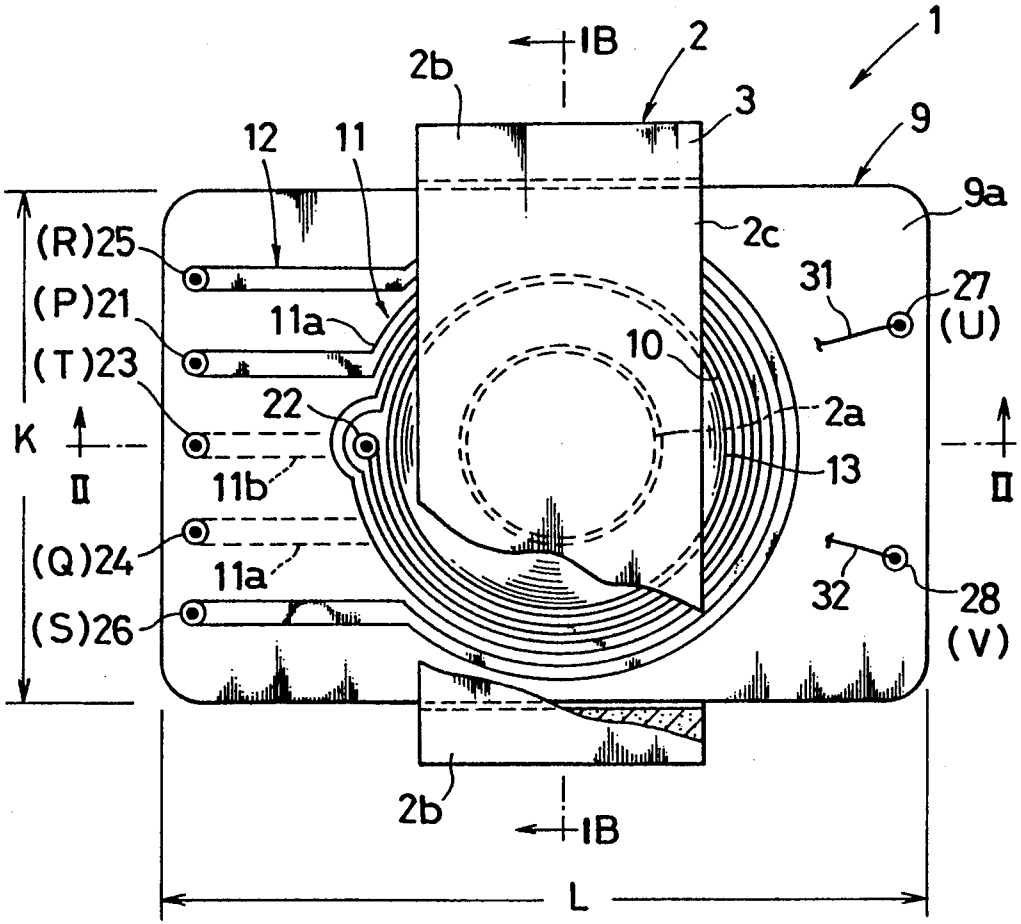
Figure 2:
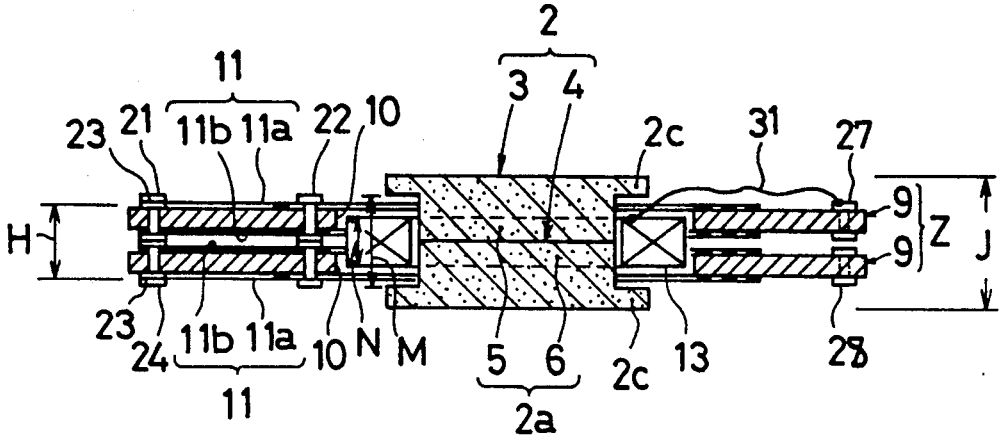

As shown in FIG. 1 and FIG. 2, a transformer 1 is formed flat, having approximate outer dimensions of a 25 mm (approx. 1 inch) longitudinal length K, a 30 mm lateral length L, and a 2.5 mm thickness J.

A magnetic core 2 of the transformer 1 is formed vertically thin and composed of an upper segment 3 and a lower segment 4 which are each formed in section into an E shape and joined together. An inner portion 5 of the upper segment 3 and an inner portion 6 of the lower segment 4 constitute an inner portion 2*a* of the magnetic core 2. Also, an outer portion 7 of the upper segment 3 and an outer portion 8 of the lower segment 4 constitute an outer portion 2*b* of the magnetic core 2. The inner portion 2*a* and two outer portions 2*b*, 2*b* are interconnected via upper and lower linking portions 2*c*, 2*c* so as to form a closed magnetic circuit.

The upper segment 3 and the lower segment 4 sandwich two sheets of upper and lower insulating substrates 9, 9. A through hole 10 is formed between front surface 9*a* and rear surface 9*b* of the substrates 9. The rear surfaces 9*b*, 9*b* of the two substrates 9, 9 are opposed to each other.

On each substrate 9 there are provided a first pattern coil 11 and a second pattern coil 12. These pattern coils 11 and 12 are formed by printed wiring. Further, a winding coil 13 is inserted into an annular space between the inner portion 2*a* and the through hole 10. This winding coil 13 is formed bobbinless by winding around a weldable insulating wire.

Figure 4:
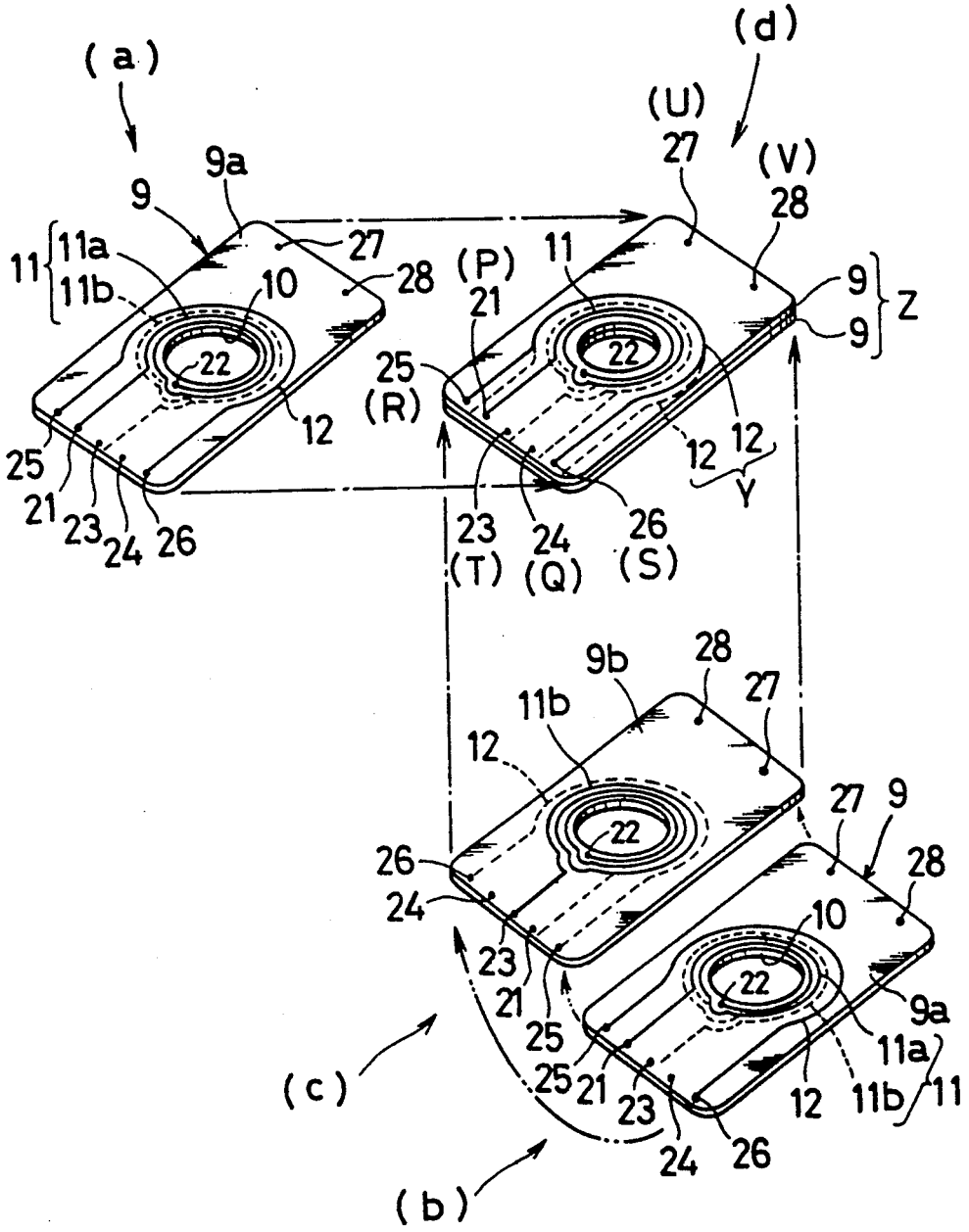

As shown in FIG. 1 and FIG. 2, or in FIG. 4, the first pattern coil 11 is formed by connecting in series a front coil 11*a* and a rear coil 11*b* which are both a scroll conductor pattern. The front coil 11*a* is formed outside the through hole 10 on the front surface 9*a* of the substrate 9 in such a way that the radius becomes smaller as the coil goes on in the clockwise direction as viewed from the top. Similarly, the rear coil 11*b* is also formed outside the through hole 10 on the rear surface 9*b* of the substrate 9 in such a way that the radius becomes larger as the coil goes on in the clockwise direction as viewed from the top.

The larger-diameter starting point of the front coil 11*a* is connected to a first through hole conductor 21, which first through hole conductor 21 serves as a terminal P. The smaller-diameter terminating point of the front coil 11*a* and the smaller-diameter starting point of the rear coil 11*b* are connected to each other via a second through hole conductor 22. The larger-diameter terminating point of the rear coil 11*b* is connected to a third through hole conductor 23. Designated by reference numeral 24 is a fourth through hole conductor for connection between upper and lower segments.

The second pattern coil 12, made of a C-shaped conductor pattern, is formed outside the front coil 11*a* on the front surface 9*a* of the substrate 9. Two ends of the second pattern coil 12 are connected to a fifth through hole conductor 25 and a sixth through hole conductor 26, respectively.

Prior to assembling the transformer 1, the substrate 9 in which the first pattern coil 11 and the second pattern coil 12 have been formed previously as described above, are prepared two in number. These substrates 9, 9 are joined together vertically by the aforementioned procedure shown in FIG. 4.

Indicated by arrow (a) in FIG. 4 is the upper substrate 9, and by arrow (b) is the lower substrate 9. Each front surface 9*a* of the two substrates 9, 9 is directed upward. First, the lower substrate 9 is reversed upside down, as indicated by arrow (c). Then, as shown in arrow (d), the rear surface 9*b* of the lower substrate 9 is joined with the rear surface 9*b* of the upper substrate 9 from below. These two substrates 9, 9 constitute a laminated member Z. It is to be noted that between the upper and lower substrates 9, 9, on the upper surface of the front coil 11*a* of the upper substrate 9, and on the lower surface of the front coil 11*a* of the lower substrate 9, there are fitted insulating sheets (not shown) each having a thickness of 12 $\mu$ to 25 $\mu$.

Figure 3:
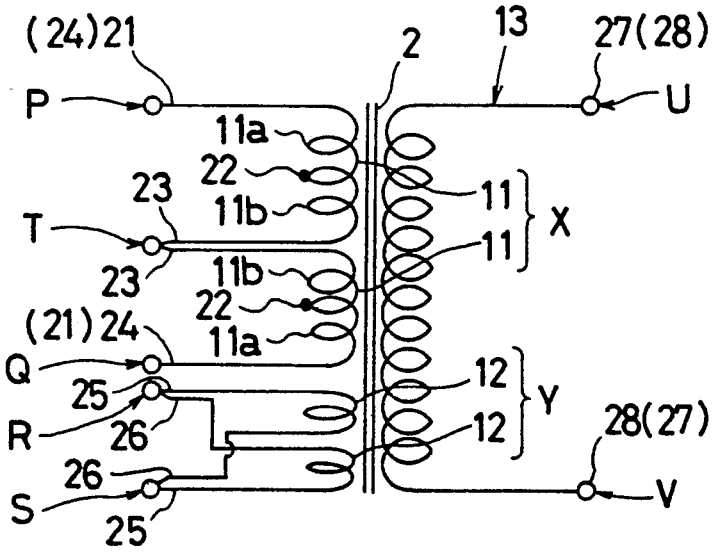

As shown in FIG. 4 and FIG. 3, a terminal Q is formed by joining together the fourth through hole conductor 24 of the upper substrate 9 and the first through hole conductor 21 of the lower substrate 9. More specifically, the aforementioned terminal P and the terminal Q are connected to each other via the following path.

Referring to the upper substrate 9, connected in series are the first through hole conductor 21, the front coil 11*a*, the second through hole conductor 22, the rear coil 11*b*, and the third through hole conductor 23, thereby forming the first pattern coil 11. Referring to the lower substrate 9, connected in series are the third through hole conductor 23, the rear coil 11*b*, the second through hole conductor 22, the front coil 11*a*, and the first through hole conductor 21, thereby forming the first pattern coil 11. The upper and lower third through hole conductors 23 and 23 are joined together, forming a center tap T. In this way, the upper and lower first pattern coils 11 and 11 are connected in series, whereby a main coil X is formed.

Furthermore, the fifth through hole conductor 25 of the upper substrate 9 and the sixth through hole conductor 26 of the lower substrate 9 are joined together, thereby forming a terminal R. The sixth through hole conductor 26 of the upper substrate 9 and the fifth through hole conductor 25 of the lower substrate g are joined together, thereby forming a terminal S. In this way, the second pattern coils 12 and 12 are connected in parallel, whereby a subcoil Y is formed.

As shown in FIG. 1 and FIG. 2, one end of the winding coil 13 is connected to a terminal U via a lead wire 31. This terminal U is formed by joining together a seventh through hole conductor 27 of the upper substrate 9 and an eighth through hole conductor 28 of the lower substrate 9. Also, the other end of the winding coil 13 is connected to a terminal V via another lead wire 32. This terminal V is formed by joining together the eighth through hole conductor 28 of the upper substrate 9 and the seventh through hole conductor 27 of the lower substrate 9.

It is noted here that, as shown in FIG. 2, thickness H of the laminated member Z is set to a value smaller than the protrusion height M of the inner portion 2*a* of the magnetic core 2 and greater than the thickness N of the winding coil 13.

Next described is the procedure for mounting the transformer 1 onto a back-light power supply PCB (not shown). In the PCB, a rectangular hole is previously formed so as to meet the plane configuration of the magnetic core 2 of the transformer 1. In mounting, first the magnetic core 2 is fitted into the rectangular hole. Then, the aforementioned seven terminals P through V are put into contact with the conductor plane of the PCB, and subsequently soldered to accomplish the connection between the terminals P through V and the conductor plane.

The above-described embodiment offer the following advantages.

The inner portion 2*a* of the magnetic core 2, the winding coil 13, and the laminated member Z are arranged radially in order, such that these three members 2*a*, 13, and Z will not overlap one another in the vertical direction. Thus, the thickness J of the transformer 1 can be reduced by the thickness N of the winding coil 13.

Since the bobbin for the winding coil 13 has been omitted, the transformer 1 can be made more compact accordingly. The transformer 1 is reduced in the number of parts by the omission of the bobbin, and also reduced in cost by the elimination of the need for manufacturing dies for molding the bobbin.

Figure 5A:
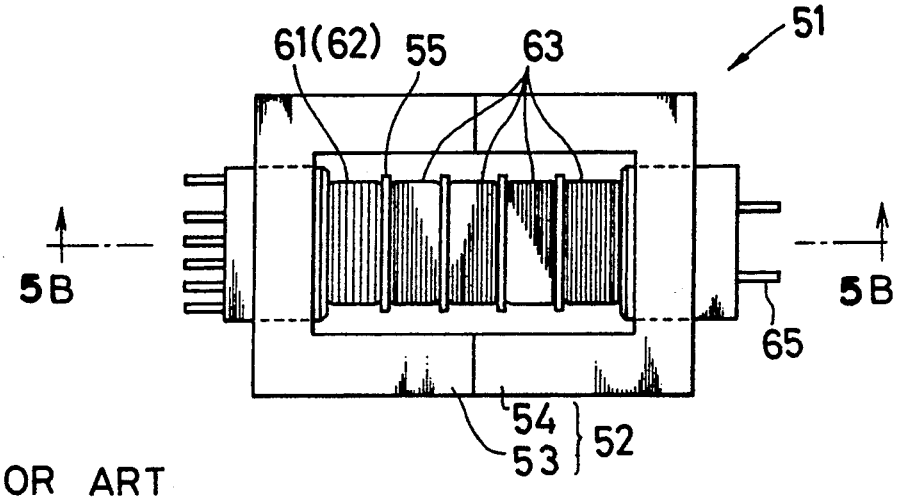
PRIOR ART FIG. 5(A)
FIG. 5 (A) is a plan view of a conventional transformer.
Figure 5B:
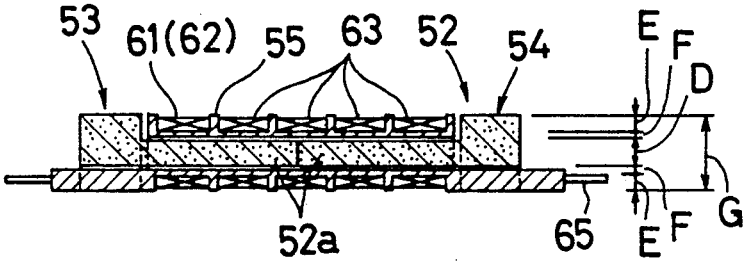
PRIOR ART FIG. 5(B)
Figure 5C:
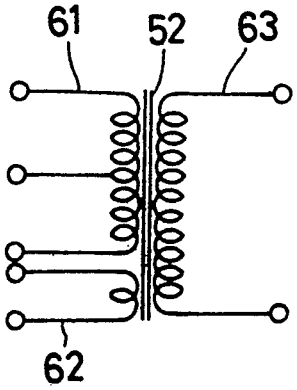
PRIOR ART FIG. 5(C)

In mounting the transformer 1, it is proper to join the through hole conductors 21 to 28 to a mounting-use PCB by soldering or the like, which allows the omission of the process of bending the lead terminals as shown for the prior art in FIG. 5. This also contributes to cost reduction.

Since the upper segment 3 and the lower segment 4 of the magnetic core 2 have been implemented by identical parts, the transformer 1 is reduced in the number of parts, which also contributes to cost reduction.

Since the first pattern coil 11 has been implemented by the front coil 11*a* on the front surface 9*a* and the rear coil 11*b* on the rear surface 9*b* of the substrates 9, the coil density results in a great one, so that the transformer 1 can be made compact. Since the main coil X has been implemented by stacking two thin sheets of substrates 9 which are provided with a first pattern coil 11, the transformer 1 can be made even more compact.

Since the center tap T can be formed by joining together the third through hole conductors 23, 23 of the upper and lower substrates 9, 9, it is easy to mass-produce the transformer 1 with a center tap.

The subcoil Y has been implemented by two second pattern coils 12, 12, which are connected in parallel, the d.c. resistance and impedance result in lower ones.

In addition, the above-described embodiment may be modified as follows.

The magnetic core 2 is only required to be segmentable vertically into an upper segment 3 and a lower segment 4. It, therefore, may be implemented by vertically asymmetrical parts. The winding coil 13 may be one with a bobbin. The transformer 1 may also be provided with only one substrate 9, where at least one pattern coil is provided on only one of the front and rear surfaces of the substrate 9. The center tap T may be omitted.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A flat transformer comprising:

a magnetic core (2) having an inner portion (2*a*) and two outer portions (2*b*), (2*b*), which are interconnected so as to form a closed magnetic circuit, the magnetic core being formed so as to be vertically thin and vertically segmentable;

a substrate (9) having a front surface (9*a*) and a rear surface (9*b*), and a through hole (10) provided between these surfaces (9*a*), (9*b*), the substrate being inserted between the two outer portions (2*b*), (2*b*), the inner portion (2*a*) being inserted into the through hole (10);

a pattern coil (11) implemented by a scroll conductor pattern and formed on at least one of the two surfaces (9*a*), (9*b*) outside the through hole (10); and a winding coil (13) formed into a thin ring shape and inserted into an annular space between the inner portion (2*a*) and the through hole (10).

2. A transformer as claimed in claim 1, wherein the winding coil (13) is implemented by a bobbinless coil.

3. A transformer as claimed in claim 1, wherein both ends of the pattern coil (11) are connected to through hole conductors (21), (23), respectively.

4. A transformer as claimed in claim 1, wherein the magnetic core (2) is implemented by vertically symmetrical upper segment (3) and lower segment (4).

5. A transformer as claimed in claim 1, wherein the pattern coil (11) comprises a front coil (11*a*) formed on the front surface (9*a*) and a rear coil (11*b*) formed on the rear surface (9*b*).

6. A transformer as claimed in claim 5, wherein the substrate (9) is overlaid one on another in a plural number to form a laminated member (Z).

7. A transformer as claimed in claim 5, wherein the substrate (9) is provided two in number above and below, and a further pattern coil (12) is provided outside the front coil (11*a*) on the front surface (9*a*) of each substrate (9);

the rear surface (9*b*) of the upper substrate (9) and the rear surface (9*b*) of the lower substrate (9) are joined together to form the laminated member (Z);

the two pattern coils (11), (11) are connected in series to form a main coil (X); and wherein the further pattern coils (12), (12) are connected in parallel to form a subcoil (Y).

* * * * *